US007731040B2

(12) United States Patent
Kobayashi

(10) Patent No.: US 7,731,040 B2
(45) Date of Patent: Jun. 8, 2010

(54) CRAWLER CRANE

(75) Inventor: Yutaka Kobayashi, Akashi (JP)

(73) Assignee: Kobelco Cranes Co., Ltd., Tokyo (JP)

( * ) Notice: Subject to any disclaimer, the term of this patent is extended or adjusted under 35 U.S.C. 154(b) by 0 days.

(21) Appl. No.: 12/246,540

(22) Filed: Oct. 7, 2008

(65) Prior Publication Data

US 2009/0159346 A1 Jun. 25, 2009

(30) Foreign Application Priority Data

Dec. 25, 2007 (JP) ..... 2007-331295

(51) Int. Cl.
*B66C 13/53* (2006.01)

(52) U.S. Cl. ..... 212/291; 60/456; 180/68.1; 212/271

(58) Field of Classification Search ..... 212/230, 212/231, 232, 271, 291; 280/832, 834; 180/312, 180/68.1; 60/456
See application file for complete search history.

(56) References Cited

U.S. PATENT DOCUMENTS

| | | | | |
|---|---|---|---|---|
| 5,215,164 | A * | 6/1993 | Shibata | 184/6.13 |
| 5,607,071 | A * | 3/1997 | Kroll et al. | 212/231 |
| 6,520,358 | B1 | 2/2003 | Kobayashi et al. | |
| 6,523,905 | B2 * | 2/2003 | Tamura et al. | 298/22 R |
| 2003/0168034 | A1 * | 9/2003 | Nakajima et al. | 123/198 B |
| 2007/0175849 | A1 | 8/2007 | Yokoyama et al. | |

FOREIGN PATENT DOCUMENTS

| | | |
|---|---|---|
| EP | 0745528 | 12/1996 |
| JP | 2000-136089 | 5/2000 |
| JP | 2000-144811 | 5/2000 |
| JP | 2002-309621 | 10/2002 |
| JP | 2004-136992 | 5/2004 |
| JP | 2005-314106 | 11/2005 |

* cited by examiner

*Primary Examiner*—Thomas J. Brahan
(74) *Attorney, Agent, or Firm*—Oblon, Spivak, McClelland, Maier & Neustadt, L.L.P.

(57) ABSTRACT

In a crawler crane of the present invention, a plurality of winches 11-14 for winding wire ropes are disposed on a rotating frame 6 of an upper rotating body 3 in a row in a plane view. A cabin 17 and a power unit 18 are disposed on the front and rear portions of either a right side or a left side of the rotating frame 6 of the upper rotating body 3. A working oil tank 36 of the power unit 18 is disposed between the cabin 17 and a driving section 31-34 of the power unit and in close proximity to a rear surface of the cabin 17. The working oil tank 36 is formed in a size which covers the substantially whole area of the rear surface of the cabin 17. In the crawler crane of the present invention, it is possible to take an anti-sound measure for the cabin to a satisfactory extent without causing cost increase. In the crawler crane of the present invention, moreover, it is possible to improve the transportability because the width of the upper rotating body can be shortened.

4 Claims, 3 Drawing Sheets

CRAWLER CRANE

BACKGROUND OF THE INVENTION

1. Field of the Invention

The present invention relates to a crawler crane and more particularly to a layout of a cabin and a power unit both mounted on an upper rotating body.

2. Description of Related Art

Generally, an upper rotating body of a crawler crane is provided, as a frame structure, with a rotating frame located centrally and extending along the longitudinal direction, and right and left deck frames mounted on right and left sides of the rotating frame respectively. An example of such a crawler crane is disclosed, for example, in Japanese Patent Laid-Open Publication No. 2005-314106 (US2007/0175849A1). In this example, a base end of a boom is supported pivotally at a front end of a rotating frame. Moreover, plural winches for winding wire ropes which are used for winding up or winding down lifting hooks suspended from a front end of the boom are disposed on the rotating frame longitudinally in a row in a plane view. Further, a cabin is usually disposed on one of the deck frames disposed on both sides of the rotating frame and a power unit comprising an engine and a hydraulic pump is disposed on the other deck frame. The power unit, which is also called a power plant or a power source, is disposed on the other deck frame longitudinally, namely, the longitudinal direction of the power unit is directed in the front and rear direction of the crawler crane.

In the case of such an upper rotating body, its width is determined by the sum of the width of the winches disposed on the rotating frame, the width of the cabin disposed on one deck frame, and the width of the power unit disposed on the other deck frame. For enhancing the easiness of workability or transportability when disassembling the crawler crane, and mounting/transporting the upper rotating body on a trailer, it is desired that the width of the upper rotating body be shortened as small as possible.

To meet such a requirement, it is proposed that both cabin and power unit, which are large in occupying width, be disposed on the front and rear portions of one and the same deck frame. An example of such a crawler crane is disclosed in Japanese Patent Laid-Open Publication No. 2000-136089 (U.S. Pat. No. 6,520,358 B1). In the case of this example, it is necessary that a soundproof material of a large mass be provided on a rear surface of the cabin lest sounds generated from a driving power section involving the engine and the hydraulic pump in the power unit should be propagated to the interior of the cabin through the rear surface of the cabin. However, using such an anti-sound measure causes the problem that the cost increases.

SUMMARY OF THE INVENTION

It is an object of the present invention to provide a crawler crane which utilizes a working oil tank, one of components of a power unit, as a soundproof material disposed on a rear surface of a cabin, and which thereby can attain a satisfactory anti-sound measure for the cabin without the cost increase.

It is another object of the present invention to provide a crawler crane wherein the width of an upper rotating body is shortened to a minimum and which can thereby exhibit a high transportability.

The crawler crane of the present invention is provided with a rotating frame, plural winches, a cabin and a power unit. The plural winches are disposed on the rotating frame in a row in a plane view. The cabin and the power unit are disposed on either a right side or a left side of the rotating frame. The power unit is mainly provided with a driving power section and a working oil tank. The working oil tank is disposed between the cabin and the driving power section of the power unit and in close proximity to a rear surface of the cabin. The working oil tank is formed in a size which covers the substantially whole area of the rear surface of the cabin.

In the present invention, it is preferable that the working oil tank be mounted on the rotating frame through an elastic bushing. It is also preferable that the working oil tank be formed in a shape of a rectangular parallelepiped of which width and height lengths are substantially equal to width and height lengths of the rear surface of the cabin respectively, and further of which depth length is not larger than the half of the width length of the working oil tank.

Thus, in the present invention, the working oil tank which covers the substantially whole area of the rear surface of the cabin is disposed between the cabin and the driving power section (for example, including an engine and hydraulic pumps) of the power unit and in close proximity to the rear surface of the cabin. Therefore, sounds generated from the driving power section of the power unit are insulated by the working oil tank and the working oil contained therein, and thus the sound propagation to the interior of the cabin is prevented. Besides, since the working oil tank never becomes empty during operation of the power unit, namely, during operation of the crawler crane, the sound preventing effect attained by the working oil tank can be exhibited continuously. Moreover, since a soundproof material or the like is not necessary, there is no fear of the cost increase. Further, by shortening the width of an upper rotating body, the transportation performance of the upper rotating body is improved.

According to a preferred mode of the present invention, since the working oil tank is mounted on the frame of the upper rotating body through the elastic bushing, the vibration preventing effect for the working oil tank and the soundproofing effect in the interior of the cabin are further enhanced. Further, according to another preferred mode of the present invention, since the working oil tank is formed in a shape of a rectangular parallelepiped of which width and height lengths are substantially equal to width and height lengths of the rear surface of the cabin respectively, and further of which depth length is not larger than the half of the width length of the working oil tank, the work required at the time of disassembling the crawler crane and mounting/transporting the upper rotating body on a trailer becomes easier, thus making it possible to further enhance the transportability. It is also possible to make the rotating radius smaller.

DETAILED DESCRIPTION OF THE PREFERRED EMBODIMENT

An embodiment of the present invention as the best embodiment for carrying out the invention will be described hereinafter with reference to the drawings.

Figure 1:
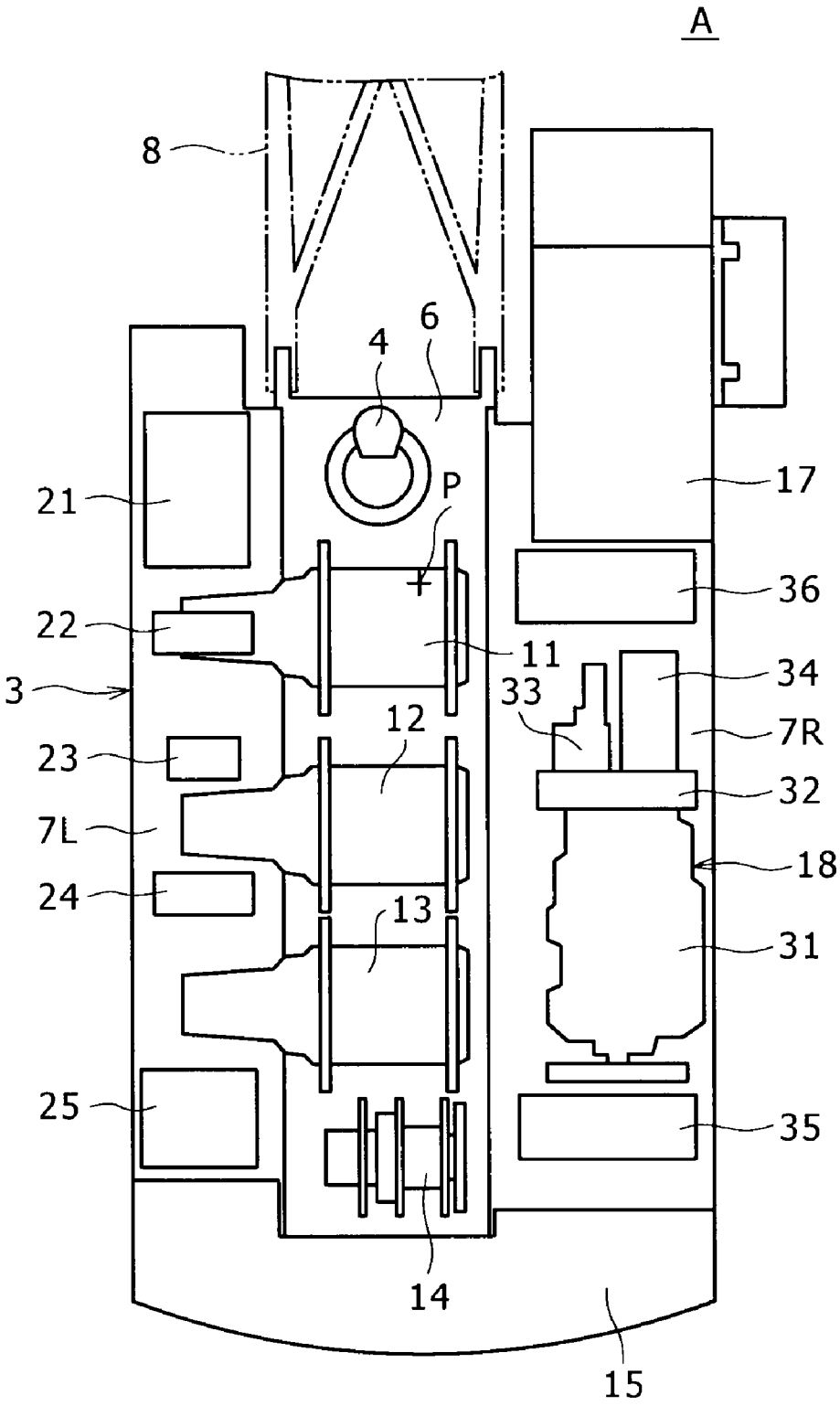
FIG. 1 is a plan view of a crawler crane according to an embodiment of the present invention.
Figure 2:
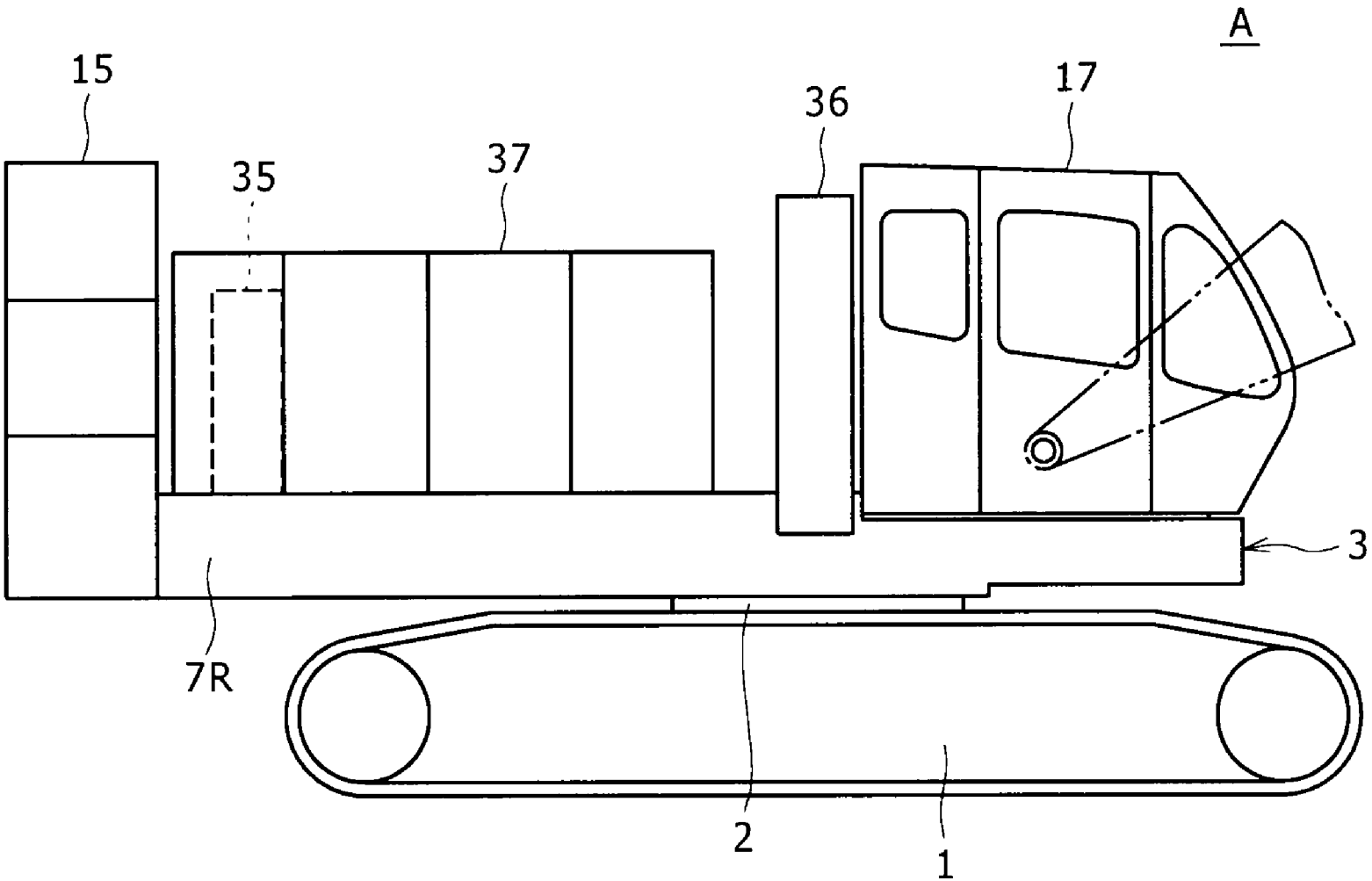
FIG. 2 is a right side view thereof.

FIGS. 1 and 2 illustrate an entire construction of a crawler crane A according to an embodiment of the present invention. The crawler crane A includes a lower traveling body 1 and an upper rotating body 3 rotatably mounted on the lower traveling body 1 through a device for rotating 2. Though not shown, the device for rotating 2 causes the upper rotating body 3 to rotate around a center point P of rotation with operation of a rotating motor 4.

The upper rotating body 3 is provided, as a frame structure thereof, with a rotating frame 6 located centrally and extending in a longitudinal direction of the upper rotating body, and with left and right deck frames 7L, 7R mounted on left and right sides of the rotating frame 6 respectively. A base end of a boom 8 is supported pivotally at a front end of the rotating frame 6. On the rear side from the vicinity of the center point P of rotation of the rotating frame 6, a main winch 11 for winding a wire rope, an auxiliary winch 12, a third winch 13 and a boom raising/lowering winch 14 are disposed in a row in a plane view. There are various uses in the crawler crane A. For example, in addition to the use as a normal crane, there are such various uses as working machines having a hammer grab, a bucket for constructing a continuous wall, an earth drill, a clamshell bucket, an attachment for logging, an earth auger, or an attachment for digging a hole. Hoisting or lowering a load or a bucket required in the above uses is performed by winding up or winding down operation of the main winch 11 and the auxiliary winch 12 which are equipped as standard equipment. On the other hand, the third winch 13 is optional equipment, and it is used, for example, when hoisting an excavating attachment in using the hammer grab, or when drawing a vibratory hammer closer to the crawler crane.

Though not shown, a gantry is mounted to a rear portion of the rotating frame 6. A lower spreader is provided on the top of the gantry. The boom raising/lowering winch 14 raises and lowers the boom 8 by winding one end of a boom raising/lowering wire rope through the lower spreader. A counter weight 15 is attached to a rear end of the rotating frame 6.

Looking toward the front side of the upper rotating body 3, a cabin 17 is disposed on the front side of the right deck frame 7R located on the right side of the rotating frame 6, and a power unit 18 is disposed on the rear side thereof. On the other hand, a fuel tank 21 is disposed on the front side of the left deck frame 7L located on the left side of the rotating frame 6, three hydraulic valve units 22, 23, 24 are disposed at an intermediate portion thereof, and a battery 25 is disposed on the rear side thereof. The three hydraulic valve units 22, 23, and 24 correspond to the main winch 11, auxiliary winch 12, and third winch 13, respectively.

A driving power section of the power unit 18 is provided with an engine 31, a power divider 32 for dividing the output of the engine 31, and plural hydraulic pumps 33, 34 which are driven by the engine outputs divided by the power divider 32. The power unit 18 is disposed along a longitudinal direction of the upper rotating body 3, so that the direction of the shaft of the engine 31 extends along the front-rear line direction of the upper rotating body 3, and so that the engine 31 is located on the rear side of the power unit 18. The power unit 18 also includes a working oil tank 36 and a radiator 35 in addition to the driving power section 31 to 34. The radiator 35 is disposed at the back of the engine 31 so as to oppose to the engine 31. Normally, upper and side portions of the power unit 18, including the engine 31, the radiator 35 and the like, are covered with a hood 37. However, in FIG. 1, the engine 31, etc. are shown in a state that the hood 37 is removed.

Figure 3:
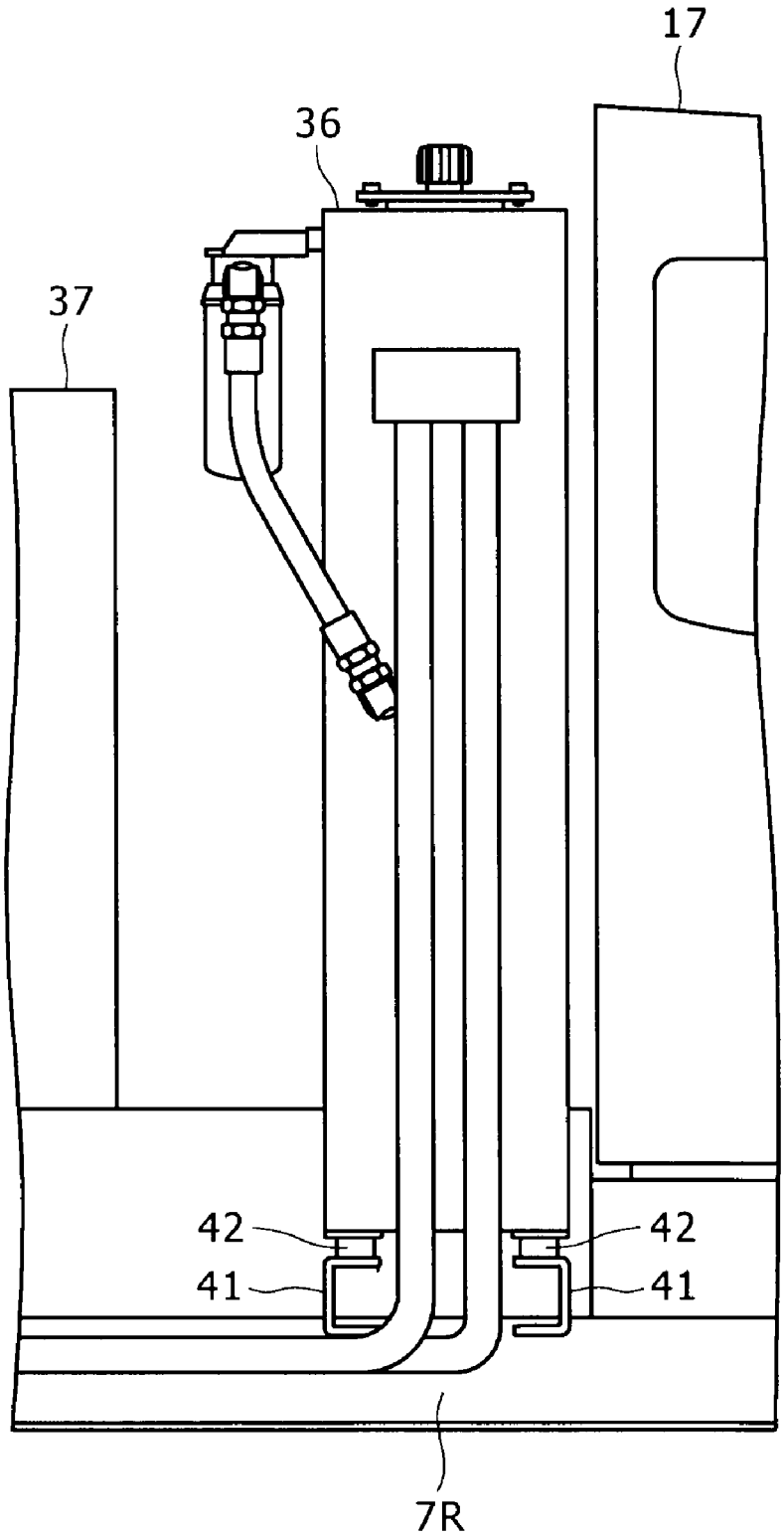
FIG. 3 is an enlarged view of a vicinity of a working oil tank shown in FIG. 2.

On the other hand, as shown in FIG. 3, the working oil tank 36 is disposed between the cabin 17 and the driving power section 31-34 of the power unit 18 and in close proximity to a rear surface of the cabin 17. The working oil tank 36 is formed in a size which covers the substantially whole area of the rear surface of the cabin 17. More specifically, the working oil tank 36 is formed in a shape of a rectangular parallelepiped of which width and height lengths substantially equal to width and height lengths of the rear surface of the cabin 17. A depth length of the working oil tank 36 is set not larger than the half of the width length thereof. The working oil tank 36 is mounted through elastic bushings 42 onto two transversely extending cross frames 41 of the deck frame 7R.

In the above embodiment, the cabin 17 and the power unit 18 each having a large occupying width are disposed on the front and rear portions of the right deck frame 7R located on the right side of the rotating frame 6 of the upper rotating body 3. Therefore, in the above embodiment, the width length of the left deck frame 7L located on the left side of the rotating frame 6 can be shortened, and hence it is possible to shorten the width of the upper rotating body 3. As a result, when disassembling the crawler crane A and transporting the upper rotating body 3 mounted on a trailer, the associated work becomes easier and hence it is possible to enhance the transportability.

Besides, in disposing the cabin 17 and the power unit 18 on the front and rear portions of the right deck frame 7R located on the right side of the rotating frame 6 of the upper rotating body 3, the working oil tank 36 of the power unit 18 is disposed between the cabin 17 and the driving power section 31-34 of the power unit 18 and in close proximity to the rear surface of the cabin 17. Moreover, since the working oil tank 36 is formed in a size which covers the substantially whole area of the rear surface of the cabin 17, sounds generated from the driving power section 31-34 of the power unit 18 are insulated by the working oil tank 36 and the working oil contained therein, so that the sound propagation to the interior of the cabin 17 is prevented. Accordingly, the soundproofing effect of the interior of the cabin is improved. Further, since the working oil tank 36 never becomes empty during operation of the power unit 18, namely, during operation of the crawler crane A, the sound preventing effect attained by the working oil tank 36 can be exhibited continuously. Consequently, the soundproofing effect in the interior of the cabin 17 can be ensured continuously. Moreover, since a soundproof material or the like is not needed, the width of the upper rotating body 3 can be shortened without causing any cost increase, thus making it possible to improve the transportability.

Further, since the working oil tank 36 is mounted onto the two cross frames 41, 41 of the deck frame 7R through the elastic bushings 42, 42, it is possible to further enhance the sound preventing effect by the working oil tank 36, namely, the soundproofing effect in the interior of the cabin 17.

Additionally, since the oil working tank 36 is disposed in close proximity to the rear surface of the cabin 17, and since the depth length of the working oil tank 36 is set at a value being not larger than the half of the width length thereof, which is relatively small, there is no fear that the rotating radius of the upper rotating body 3 becomes larger as a result of installation of the working oil tank 36.

The present invention is not limited to the above embodiment, but various other embodiments should be included therein. For example, in the above embodiment, the frame structure of the upper rotating body 3 is constituted by the rotating frame 6 located centrally and the left and right deck frames 7L, 7R. However, the present invention is not limited to this embodiment, but is also applicable, for example, to an upper rotating body having an integral structure of a rotating frame and deck frames. The present invention is further applicable to an upper rotating body wherein the deck frames are substituted by mere cross frames.

Although, in the above embodiment, the cabin 17 and the power unit 18 are disposed on the right deck frame 7R, they may be disposed on the left deck frame 7L to the contrary.

Although, in the above embodiment, the driving power section of the power unit 31 is provided with the engine 31, the power divider 32 and the hydraulic pumps 33, 34, it goes without saying that the present invention is also applicable to other constructions including other devices for generating driving power for a crawler crane.

Moreover, the working oil tank 36 of the above embodiment is formed in a size which covers the substantially whole area of the rear surface of the cabin 17. However, the working oil tank of the present invention is not limited to the above embodiment. The working oil tank of the present invention may have some holes, recessions or cut-off portions and the like which are substantially harmless for its soundproof effect.

Although the invention has been described with reference to the preferred embodiments in the attached figures, it is noted that equivalents may be employed and substitutions made herein without departing from the scope of the invention as recited in the claims.

The invention claimed is:

1. A crawler crane comprising:

a rotating frame;

a plurality of winches disposed on said rotating frame in a row as seen in a plan view; and a cabin and a power unit, both of which are disposed on either a right side or a left side of said rotating frame, said power unit including a driving power section and a working oil tank, said working oil tank being disposed between said cabin and said driving power section of said power unit and in close proximity to a rear surface of said cabin, said working oil tank having a size and shape such that the working oil tank covers substantially the whole area of said rear surface of said cabin.

2. A crawler crane according to claim 1, wherein said working oil tank is mounted on said rotating frame through an elastic bushing.

3. A crawler crane according to claim 1, wherein said working oil tank is formed in a shape of a rectangular parallelepiped whose width and height are substantially equal to a width and height of said rear surface of said cabin, respectively.

4. A crawler crane according to claim 3, wherein a depth of said working oil tank is not larger than half of the width of said working oil tank.

* * * * *